US005262008A

United States Patent [19]

Moench et al.

[11] Patent Number: 5,262,008

[45] Date of Patent: Nov. 16, 1993

[54] PRODUCTION OF PAPER, BOARD AND CARDBOARD IN THE PRESENCE OF COPOLYMERS CONTAINING N-VINYLFORMAMIDE UNITS

[75] Inventors: Dietmar Moench, Weinheim; Heinrich Hartmann, Limburgerhof; Enrique Freudenberg, Schifferstadt; Andreas Stange, Mannheim, all of Fed. Rep. of Germany

[73] Assignee: BASF Aktiengesellschaft, Ludwigshafen, Fed. Rep. of Germany

[21] Appl. No.: 623,954

[22] PCT Filed: Mar. 14, 1990

[86] PCT No.: PCT/EP90/00406

§ 371 Date: Dec. 4, 1990

§ 102(e) Date: Dec. 4, 1990

[87] PCT Pub. No.: WO90/11404

PCT Pub. Date: Oct. 4, 1990

[30] Foreign Application Priority Data

Mar. 18, 1989 [DE] Fed. Rep. of Germany ..... 3909004

[51] Int. Cl.[5] ..... D21H 17/45

[52] U.S. Cl. ..... 162/168.2; 162/168.3; 162/175

[58] Field of Search ..... 162/164.6, 168.2, 168.3, 162/175

[56] References Cited

U.S. PATENT DOCUMENTS 3,597,314 8/1971 Laube et al. ..... 162/168.2
4,772,359 9/1988 Linhart et al. ..... 162/168.2
4,818,341 4/1989 Degen et al. ..... 162/168.2

*Primary Examiner*—Peter Chin
*Attorney, Agent, or Firm*—Oblon, Spivak, McClelland, Maier & Neustadt

[57] ABSTRACT

Paper, board and cardboard are produced by draining a paper stock in the presence of a nonhydrolyzed copolymer which contains, as polymerized units, (a) from 99 to 1 mol % of N-vinylformamide and (b) from 1 to 99 mol % of one or more water-soluble basic monomers of the formula

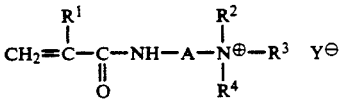

(I)

or

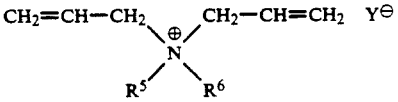

(II)

where $R^1$ is H, $CH_3$ or $C_2H_5$, $R^2$, $R^3$ and $R^4$ are each H, $CH_3$, $C_2H_5$ or $(-CH_2-CH_2-O-)_nH$, $R^5$ and $R^6$ are each $C_1$-$C_{10}$-alkyl, A is $C_1$-$C_6$-alkylene, n is from 1 to 6 and $Y^{\ominus}$ is an anion, in an amount of from 0.01 to 3.5% by weight, based on dry paper stock.

2 Claims, No Drawings

PRODUCTION OF PAPER, BOARD AND CARDBOARD IN THE PRESENCE OF COPOLYMERS CONTAINING N-VINYLFORMAMIDE UNITS

The present invention relates to a process for the production of paper, board and cardboard by draining a paper stock in the presence of copolymers containing N-vinylformamide units.

JP-A-118 406/86 discloses water-soluble polyvinylamines which are prepared by polymerizing N-vinylformamide or mixtures of N-vinylformamide with other water-soluble monomers, such as acrylamide, N,N-dialkylacrylamides or diallyldialkylammonium salts and subsequently hydrolyzing the polymers with bases, e.g. ethylamine, diethylamine, ethylenediamine or morpholine. The polyvinylamines are used as drainage aids and retention aids in papermaking and as flocculants for wastewaters.

U.S. Pat. No. 4,421,602 discloses polymers which are obtainable by partial hydrolysis of polyl-N-vinylformamide with acids or bases. As a result of the hydrolysis, these polymers contain vinylamine and N-vinylformamide units. They are used, for example in papermaking, as drainage aids, flocculants and retention aids.

EP-A-0 220 603 discloses, inter alia, that N-vinylformamide can be subjected to copolymerization together with basic acrylates, such as dimethylaminoethyl acrylate, or N-vinylimidazolines, in supercritical carbon dioxide. The resulting finely divided copolymers are used in the partially hydrolyzed form, in which they contain vinylamine units, for example as retention aids and flocculants in papermaking.

EP-A-0 282 761 discloses a process for the production of paper, board and cardboard having high dry strength, in which the dry strength agent used is a mixture of cationic polymers, which may also contain, among typical monomers, polymerized units of vinylamine, and natural potato starch, the potato starch being converted into a water-soluble form by heating in an aqueous medium in the presence of a cationic polymer to temperatures above the gelatinization temperature of natural potato starch in the absence of oxidizing agents, polymerization initiators and alkali.

It is an object of the present invention to provide papermaking assistants which ideally are more effective than the conventional ones and which are technically more readily available.

We have found that this object is achieved, according to the invention, by a process for the production of paper, board and cardboard by draining a paper stock in the presence of a polymer containing N-vinylformamide units, if a nonhydrolyzed copolymer which contains, as polymerized units, (a) from 99 to 1 mol % of N-vinylformamide and (b) from 1 to 99 mol % of one or more water-soluble basic monomers of the formula

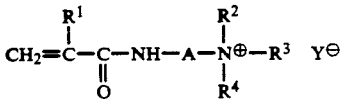

(I)

or

-continued

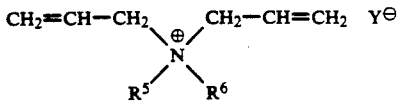

(II)

where $R^1$ is H, $CH_3$ or $C_2H_5$, $R^2$, $R^3$ and $R^4$ are each H, $CH_3$, $C_2H_5$ or $(—CH_2—CH_2—O—)_nH$, $R^5$ and $R^6$ are each $C_1$–$C_{10}$-alkyl, A is $C_1$–$C_6$-alkylene, n is from 1 to 6 and $Y^\ominus$ is an anion, is used in an amount of from 0.01 to 3.5% by weight, based on dry paper stock, as the polymer containing N-vinylformamide units.

The advantage of the nonhydrolyzed copolymers containing N-vinylformamide units over the previously used hydrolyzed copolymers which contain vinylamine units after the hydrolysis is that the hydrolysis, which is difficult to carry out in many cases, is dispensed with and effective papermaking assistants are obtainable by direct copolymerization.

A suitable monomer (a) of the copolymers is N-vinylformamide. This monomer is present in the copolymers in an amount of from 1 to 99, preferably from 60 to 95, mol %.

Suitable monomers of group (b) are the compounds of the formula I, of which the following compounds may be stated by way of example:

N-trimethyl-N-(acrylamidoethyl)-ammonium chloride,
N-trimethyl-N-(methacrylamidoethyl)-ammonium chloride,
N-trimethyl-N-(acrylamidoethyl)-ammonium methosulfate,
N-trimethyl-N-(methacrylamidoethyl)-ammonium methosulfate,
N-ethyldimethyl-N-(methacrylamidomethyl)-ammonium ethosulfate,
N-ethyldimethyl-N-(acrylamidomethyl)-ammonium ethosulfate,
N-trimethyl-N-(acrylamidopropyl)-ammonium chloride,
N-trimethyl-N-(methacrylamidopropyl)-ammonium chloride,
N-trimethyl-N-(acrylamidopropyl)-ammonium methosulfate,
N-trimethyl-N-(methacrylamidopropyl)-ammonium methosulfate,
N-ethyldimethyl-N-(methacrylamidopropyl)-ammonium ethosulfate and
N-ethyldimethyl-N-(acrylamidopropyl)-ammonium ethosulfate.

N-Trimethyl-N-(methacrylamidopropyl)-ammonium chloride is preferred.

Other suitable monomers of group (b) are the compounds of the formula II. Examples of compounds of this type are diallyldimethylammonium chloride, diallyldimethylammonium bromide, diallyldiethylammonium chloride and diallyldiethylammonium bromide. Diallyldimethylammonium chloride is preferably used. The anion $Y^\ominus$ is an acid radical and is preferably chloride, bromide, iodide, sulfate, methosulfate or ethosulfate.

Among the monomers of group (b), the compounds of the formula I or II may be present in the copolymers either alone or as a mixture with one another. It is also possible to use a plurality of compounds of the formula I or II in the copolymerization of the monomer (a). The monomers of group (b) are present in the copolymers in an amount of from 99 to 1, preferably from 40 to 5, mol %.

The copolymerization of the monomers (a) and (b) is carried out in aqueous solution in the presence of polymerization initiators which decompose into free radicals under the polymerization conditions. Examples of suitable polymerization initiators are hydrogen peroxide, alkali metal and ammonium salts of peroxydisulfuric acid, peroxides, hydroperoxides, redox catalysts and in particular nonoxidizing initiators, such as azo compounds which decompose into free radicals. Water-soluble azo compounds, such as 2,2'-azobis-(2-amidinopropane) dihydrochloride, 2,2'-azobis-(N,N'-dimethyleneisobutyramidine) dihydrochloride or 2,2'-azobis-[2-methyl-N-(2-hydroxyethyl)-propionamide], are preferably used. The polymerization initiators are employed in conventional amounts, for example in amounts of from 0.01 to 5% by weight, based on the monomers to be polymerized. Polymerization can be carried out in a wide temperature range, under atmospheric pressure, reduced or superatmospheric pressure, in appropriately designed apparatuses. The polymerization is preferably effected under atmospheric pressure and at not more than 100° C., in particular from 30° to 80° C. The concentration of the monomers in the aqueous solution is preferably chosen to give polymer solutions whose solids content is from 10 to 90, preferably from 20 to 70, % by weight. The pH of the reaction mixture is brought to 4–10, preferably 5–8.

Depending on the polymerization conditions, copolymers having different molecular weights are obtained. To characterize a copolymer, the K value according to H. Fikentscher is stated instead of the molecular weight. The K values (measured in 5% strength aqueous sodium chloride solution at 25° C. and at a polymer concentration of 0.1% by weight) are from 5 to 350. Copolymers having low molecular weights and correspondingly low K values are obtained by the conventional methods, i.e. the use of relatively large amounts of peroxide in the copolymerization or the use of polymerization regulators or combinations of the two measures stated. Polymers having a high K value and high molecular weights are obtained, for example, by polymerizing the monomers by reverse suspension polymerization or by polymerizing monomers (a) and (b) by the water-in-oil polymerization process. In the reverse suspension polymerization process and in water-in-oil polymerization, saturated hydrocarbons, for example hexane, heptane, cyclohexane or decalin, or aromatic hydrocarbons, such as benzene, toluene, xylene or cumene, are used as the oil phase. The ratio of oil phase to aqueous phase in reverse suspension polymerization is, for example, from 10:1 to 1:10, preferably from 7:1 to 1:1.

In order to disperse the aqueous monomer solution in an inert hydrophobic liquid, a protective colloid is required, the purpose of which is to stabilize the suspension of the aqueous monomer solution in the inert hydrophobic liquid. The protective colloids furthermore affect the particle size of the polymer beads formed by polymerization.

Examples of suitable protective colloids are the substances described in U.S. Pat. No. 2,982,749. The protective colloids which are disclosed in German Patent 2,634,486 and are obtainable, for example, by reacting oils and/or resins, each of which have allyl hydrogen atoms, with maleic anhydride are also suitable. Other suitable protective colloids are disclosed in, for example, German Patent 2,710,372 and are obtainable by thermal or free radical solution or mass polymerization from 60–99.9% by weight of dicyclopentadiene, 0–30% by weight of styrene and 0.1–10% by weight of maleic anhydride.

Other suitable protective colloids are graft polymers which are obtainable by grafting polymers (a) of a) from 40 to 100% by weight of monovinylaromatic monomers,
b) from 0 to 60% by weight of monoethylenically unsaturated carboxylic acids of 3 to 6 carbon atoms, maleic anhydride and/or itaconic anhydride and
c) from 0 to 20% by weight of other monoethylenically unsaturated monomers, with the proviso that the sum of the percentages by weight (a) to (c) is always 100 and the polymers (A) have a number average molecular weight of from 500 to 20,000 and a hydrogenation iodine number (according to DIN 53,241) of from 1.3 to 51, with monomer mixtures of 1) from 70 to 100% by weight of acrylates and/or methacrylates of monohydric alcohols of 1 to 20 carbon atoms,
2) from 0 to 15% by weight of monoethylenically unsaturated carboxylic acids of 3 to 6 carbon atoms, maleic anhydride and/or itaconic anhydride,
3) from 0 to 10% by weight of acrylic monoesters and/or methacrylic monoesters of at least dihydric alcohols,
4) from 0 to 15% by weight of monovinylaromatic monomers and
5) from 0 to 7.5% by weight of acrylamide and/or methacrylamide, with the proviso that the sum of the percentages by weight a) to e) is always 100, at not more than 150° C. in an inert hydrophobic diluent in the presence of polymerization initiators, the monomers being used in an amount of from 97.5 to 50% by weight, based on the mixture of polymer (A) and monomers. Protective colloids of this type are described in EP-A-0290 753.

When an aliphatic hydrocarbon is used as the inert hydrophobic liquid in the reverse suspension polymerization, a mixture of an inorganic suspending agent based on modified finely divided minerals and a nonionic surfactant has proven very advantageous as the protective colloid.

The inorganic suspending agents, which have a low hydrophilic/lyophilic balance, are the agents usually employed in reverse suspension polymerization processes. The mineral component of these substances is, for example, bentonite, montmorillonite or kaolin. Finely divided minerals are modified by being treated with salts of long-chain amines, for example $C_8$–$C_{24}$-amines, or quaternary ammonium salts, the amine salts or the quaternary ammonium salts being intercalated between the individual layers of the finely divided minerals. The quaternized ammonium salts which may be used for modification preferably contain 1 or 2 $C_{10}$–$C_{22}$-alkyl radicals. The other substituents of the ammonium salts are $C_1$–$C_4$-alkyl or hydrogen. The content of free ammonium salts of the amine-modified minerals is not more than 2% by weight. Finely divided minerals modified with ammonium salts are commercially available.

The inorganic suspending agents for reverse suspension polymerization include silica which has been reacted with organosilicon compounds. A suitable organosilicon compound is, for example, trimethylsilyl chloride.

The purpose of the modification of the inorganic finely divided minerals is to improve the wettability of the minerals with the aliphatic hydrocarbon used as the outer phase of the reverse suspension polymerization. In the case of the natural minerals having a layer-like structure, for example bentonite and montmorillonite, the result of modification with amines is that the modified minerals swell in the aliphatic hydrocarbon and thus disintegrate into very fine particles. The particle size is about 1 μm, in general from 0.5 to 5 μm. The silicas reacted with organosilicon compounds have a particle size of about 10–40 nm. The modified finely divided minerals are wetted both by the aqueous monomer solution and the solvent and thus accumulate in the phase interface between the aqueous phase and the organic phase. They prevent coagulation on collision of two aqueous monomer droplets in the suspension.

After the end of the copolymerization, some of the water is distilled azeotropically so that copolymers having a solids content of from 70 to 99, preferably from 80 to 95, % by weight are obtained. The copolymers are in the form of fine beads having a diameter of from 0.05 to 1 mm.

In contrast to the prior art, the copolymers described above are used in nonhydrolyzed form as an additive to the paper stock in the production of paper, board and cardboard. These copolymers contain no vinylamine units. They increase the rate of drainage of the paper stock, so that the production speed in papermaking can be increased. The copolymers also act as retention aids for fibers and fillers and simultaneously as flocculants. To achieve the stated effects, the copolymers are added to the paper stock in amounts of from 0.01 to about 0.8% by weight, based on dry paper stock. Using larger amounts of copolymers imparts dry strength. In order to achieve such effects, the polymers are used in amounts of about 0.5–3.5% by weight, based on dry paper stock. The use of the stated copolymers together with natural potato starch as dry strength agents is particularly preferred. Such mixtures have good retention for paper fibers in the paper stock. The COD of the white water is considerably reduced by means of these mixtures compared with natural starch. The troublesome substances present in the water circulations of paper machines have only a slight adverse effect on the efficiency of the mixtures of the copolymers to be used according to the invention and natural starch. The pH of the paper stock suspension may be from 4 to 9, preferably from 6 to 8.5. These mixtures of natural starch and cationic polymer which are added to the paper stock for imparting dry strength are preferably prepared by heating natural potato starch in the presence of the nonhydrolyzed copolymers in aqueous solution to temperatures above the gelatinization temperature of the natural potato starch, in the absence of oxidizing agents, polymerization initiators and alkali. The natural potato starch is modified in this manner.

The gelatinization temperature of the starch is the temperature at which the birefringence of the starch particles is lost (cf. Ullmanns Enzyklopädie der technischen Chemie, Urban und Schwarzenberg, Munich-Berlin, 1965, 16th volume, page 322).

Modification of the natural potato starch can be carried out in various ways. A digested natural potato starch which is in the form of an aqueous solution can be reacted with the suitable cationic polymers at from 15° to 70° C. At even lower temperatures, longer contact times are required. If the reaction is carried out at even higher temperatures, for example up to 110° C., shorter contact times, e.g. from 0.1 to 15 minutes, are required. The simplest method of modifying natural potato starch is to heat an aqueous suspension of the starch in the presence of the suitable cationic copolymers to above the gelatinization temperature of the natural potato starch. For modification, the starch is generally heated to 70°–110° C., the reaction being carried out in pressure-resistant apparatuses at above 110° C. However, it is also possible first to heat an aqueous suspension of natural potato starch to 70°–110° C. and to bring the starch into solution and then to add the cationic copolymer required for modification. Solubilizing of the starch is carried out in the absence of oxidizing agents, initiators and alkali, in the course of about 3 minutes to 5 hours, preferably from 5 to 30 minutes. Higher temperatures require a shorter residence time here.

From 1 to 20, preferably from 8 to 12, parts by weight of a single suitable nonhydrolyzed cationic copolymer or of a mixture of such copolymers are used per 100 parts by weight of natural potato starch. As a result of the reaction with the cationic copolymers, the natural potato starch is converted into a water-soluble form. The viscosity of the aqueous phase of the reaction mixture increases. A 3.5% strength by weight aqueous solution of the dry strength agent has viscosities of from 50 to 10,000 mPa.s (measured according to Brookfield at 20 rpm and 20° C.).

The copolymers to be used according to the invention can be employed in the production of all known paper, cardboard and board grades, for example for the production of writing, printing and packaging papers. The papers may be produced from a large number of different fiber materials, for example from bleached or unbleached sulfite or sulfate pulp, mechanical pulp, waste paper, thermomechanical pulp (TMP) and chemothermomechanical pulp (CTMP). The basis weight of the papers may be from 30 to 200, preferably from 35 to 150, g/m$^2$, while that of cardboard may be up to 600 g/m$^2$. The papers produced using the copolymers, to be used according to the invention, as a mixture with natural potato starch have markedly improved strength compared with papers obtainable in the presence of the same amount of natural potato starch.

In the Examples which follow, parts and percentages are by weight. The viscosities were determined in aqueous solution at a solids concentration of 3.5% by weight and at 20° C. in a Brookfield viscometer at 20 rpm.

Sheet formation was carried out on a Rapid-Köthen laboratory sheet former. The dry breaking length was determined according to DIN 53,112, Sheet 1, the Mullen dry bursting pressure according to DIN 53,141, the CMT value according to DIN 53,143 and the Brecht-Inset tear propagation strength according to DIN 53,115. Testing of the sheets was carried out after conditioning for 24 hours at 23° C. and a relative humidity of 50%.

The K value of the copolymers was determined according to H. Fikentscher, Cellulosechemie 13 (1932), 58–64 and 71–74, at 25° C. in 5% strength aqueous sodium chloride solution and at a polymer concentration of 0.1% by weight; $K = k \cdot 10^3$.

The following starting materials were used:

Copolymer 1

Copolymer of 90 mol % of N-vinylformamide (VFA) and 10 mol % of 3-methacrylamidopropyltrimethylammonium chloride (MAPTAC)

Copolymer 1 was prepared by initially taking 800 g of cyclohexane and 3 g of protective colloid described in Example 1 of EP-A-0 290 753 in a 2 l flask provided with a stirrer, a thermometer, a gas inlet tube and a reflux condenser. The initially taken mixture was heated to 50° C. under a nitrogen atmosphere and while stirring at a stirrer speed of 300 revolutions per minute. As soon as this temperature had been reached, a solution of 117 g of N-vinylformamide, 80 g of a 50% strength by weight aqueous solution of 3-methacrylamidopropyltrimethylammonium chloride, 0.15 g of sodium diethylenetriaminepentaacetate, 0.65 g of 2,2'-azobis-(2-amidinopropane) dihydrochloride and 100 g of water was added in the course of 30 minutes. The pH of the aqueous phase was 6.5. The reaction mixture was then stirred for 16 hours at 50° C. Thereafter, the temperature was increased to 78° C. and 134 g of water were distilled off azeotropically with the aid of a water separator. The resulting white bead-like solid was filtered off, washed with 200 g of cyclohexane and freed from the residual solvent under reduced pressure. 163 g of a copolymer having a solids content of 96.4% by weight were obtained. The K value was 180.

Copolymers 2 to 5, whose compositions are shown in Table 1, were prepared similarly to the abovementioned preparation method.

TABLE 1

| Copolymer | Mol % VFA[1)] | Mol % MAPTAC[2)] | Solids content (%) | K value |
|---|---|---|---|---|
| 2 | 80 | 20 | 96.1 | 180 |
| 3 | 70 | 30 | 91.0 | 203 |
| 4 | 60 | 40 | 94.1 | 189 |
| 5 | 50 | 50 | 88.0 | 200 |

[1)]VFA = N-vinylformamide
[2)]MAPTAC = 3-methacrylamidopropyltrimethylammonium chloride The following polymers were used for comparison:

Copolymer 6: Homopolymer of N-vinylformamide having a solids content of 96.6% and a K value of 203, prepared similarly to the method for copolymer 1 by homopolymerization of N-vinylformamide.

Copolymer 7: Partially hydrolyzed polymer 6, which was obtained by homopolymerization of N-vinylformamide by the preparation method stated for copolymer 1, 105 g of a 38% strength hydrochloric acid being added before removal of the water and the mixture being stirred for 3 hours at 50° C. before the water was distilled off azeotropically. The degree of hydrolysis was 42%, the K value was 185 and the solids content was 93.5%.

Copolymer 8: This is likewise a hydrolyzed homopolymer of N-vinylformamide which was prepared similarly to copolymer 7, except that 211 g of 38% strength hydrochloric acid were used in the hydrolysis. The degree of hydrolysis was about 90%, the K value was 195 and the solids content was 90.6%. A degree of hydrolysis of 90% means that 90% of the formamide groups originally present in the polymer have been converted into amino groups or the corresponding ammonium salt groups.

EXAMPLES

Wood-containing and kaolin-containing newspaper stock having a consistency of 2 g/l, a pH of 6 and an alum content of 0.5% by weight was first prepared. This paper stock was used as a model substance for all Examples and Comparative Examples. With the aid of a Schopper-Riegler apparatus, the freeness (°SR), the drainage time (i.e. the time in which 600 ml of white water flow out of the apparatus) and the optical transmittance of the white water in % were first determined for the paper stock model described above. 1 l samples of the paper stock described above together with the amounts of copolymers 1 to 8 stated in Table 2 were then tested. The results obtained are shown in Table 2.

TABLE 2

| | | | % by weight of added polymer | | | | | | | | |
|---|---|---|---|---|---|---|---|---|---|---|---|
| | | | Freeness (°SR) | | | Drainage time (s) | | | Transmittance (%) | | |
| Example | Comparative Example | Copolymer | 0.01 | 0.02 | 0.04 | 0.01 | 0.02 | 0.04 | 0.01 | 0.02 | 0.04 |
| | 1 | | 58 | | | 93.6 | | | 26 | | |
| 1 | | 1 | 49 | 46 | 42 | 66.0 | 57.9 | 51.7 | 45 | 55 | 63 |
| 2 | | 2 | 47 | 43 | 38 | 60.6 | 51.2 | 43.1 | 48 | 62 | 68 |
| 3 | | 3 | 44 | 39 | 34 | 54.5 | 45.4 | 35.2 | 54 | 66 | 79 |
| 4 | | 4 | 44 | 38 | 35 | 55.0 | 43.1 | 37.0 | 55 | 67 | 75 |
| 5 | | 5 | 44 | 41 | 36 | 54.6 | 47.7 | 38.3 | 53 | 63 | 73 |
| | 2 | 6 | 56 | 56 | 56 | 89.9 | 88.9 | 88.3 | 28 | 33 | 36 |
| | 3 | 7 | 52 | 47 | 36 | 75.0 | 59.3 | 38.8 | 34 | 59 | 66 |
| | 4 | 8 | 54 | 54 | 45 | 82.0 | 81.2 | 58.6 | 34 | 35 | 48 |

To test the paper strength, the strength agents 1 to 5 which are stated below and were prepared by heating natural potato starch with the copolymers stated in Table 3 were tested.

TABLE 3

| Strength agent | Obtained by reaction with | Viscosity of the aqueous solution of the strength agent [mPa · s] |
|---|---|---|
| 1 | Copolymer 1 | 314 |
| 2 | Copolymer 3 | 850 |
| 3 | Copolymer 5 | 858 |
| 4 | Copolymer 6 (comparison) | 180 |
| 5 | Copolymer 7 (comparison) | 668 |

Strength agents 1 to 5 described above were each tested in the abovementioned paper stock. The amount added was 3.0% by weight, based on dry paper stock, in all cases. The test results are shown in Table 4.

TABLE 4

| | Strength agent No. added to paper stock | CMT value [N] | Dry bursting pressure [kPa] | Dry breaking length [m] | COD of white water [mg $O_2$/l] |
|---|---|---|---|---|---|
| Example | | | | | |
| 6 | 1 | 169 | 169 | 3266 | 128 |
| 7 | 2 | 185 | 173 | 3457 | 167 |
| 8 | 3 | 184 | 184 | 3322 | 112 |
| Comparative Example | | | | | |
| 5 | — | 126 | 136 | 2667 | 162 |
| 6 | Natural potato starch | 145 | 148 | 2836 | 276 |
| 7 | 4 | 148 | 149 | 2971 | 327 |
| 8 | 5 | 200 | 194 | 3349 | 146 |

Further strength agents were prepared by heating natural potato starch in aqueous suspension for 15 minutes at 90°–110° C. in the presence of the copolymers stated in Table 5.

TABLE 5

| Strength agent | Obtained by reaction with copolymer of ... mol % of VFA and | ... mol % of DADMAC[1)] | of K value | Viscosity of the aqueous solution of the strength agent [mPa · s] |
|---|---|---|---|---|
| 6 | 30 | 70 | 93 | 169 |
| 7 | 50 | 50 | 91 | 180 |
| 8 | 70 | 30 | 94 | 140 |

[1)]DADMAC = Diallyldimethylammonium chloride

To test strength agents 6 to 8 with regard to their efficiency, they were added to the paper stock described in Example 1 in an amount of 3.0% by weight, based on dry paper stock. The results obtained are shown in Table 6.

TABLE 6

| Example | Strength agent No. added to paper stock | CMT value [N] | Dry bursting pressure [kPa] | Dry breaking length [m] | COD of white water [mg $O_2$/l] |
|---|---|---|---|---|---|
| 9 | 6 | 182 | 191 | 3336 | 206 |
| 10 | 7 | 173 | 186 | 3177 | 251 |
| 11 | 8 | 171 | 178 | 3331 | 260 |

In order to test copolymers 1, 3 and 5 and copolymer 6 (comparison) with regard to their efficiency as dry strength agents even in the absence of added starch, they were added to the paper stock described in Example 1 in an amount of 0.5% by weight, based on dry paper stock. The results obtained are shown in Table 7.

TABLE 7

| Ex. | Comp. Ex. | Copolymer No. added to paper stock | CMT value [N] | Dry bursting pressure [kPa] | Dry breaking length [m] | COD of white water [mg $O_2$/l] |
|---|---|---|---|---|---|---|
| 12 | | 1 | 143 | 151 | 2932 | 162 |
| 13 | | 3 | 134 | 145 | 2794 | 120 |
| 14 | | 4 | 132 | 143 | 2857 | 61 |
| | 9 | 6 | 117 | 140 | 2616 | 153 |

We claim:

1. A process for the production of paper, board and cardboard by draining a paper stock in the presence of a nonhydrolyzed copolymer containing the following polymerized units, (a) from 99 to 1 mol % of N-vinylformamide and (b) from 1 to 99 mol % of one or more water-soluble basic monomers of the formula

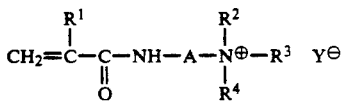

(I)

or

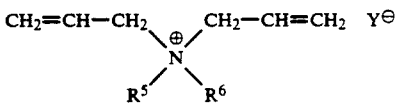

(II)

where $R^1$ is H, $CH_3$ or $C_2H_5$, $R^2$, $R^3$ and $R^4$ are each H, $CH_3$, $C_2H_5$ or $(—CH_2—CH_2—O—)_nH$, $R^5$ and $R^6$ are each $C_1$–$C_{10}$-alkyl, A is $C_1$–$C_6$-alkylene, n is from 1 to 6 and $Y^\ominus$ is an anion, said copolymer is added to the paper stock in an amount of from 0.01 to 3.5% by weight, based on dry paper stock.

2. A process as claimed in claim 1, wherein said copolymer is added to the paper stock as an aqueous solution prepared by heating natural potato starch in the presence of an aqueous solution of said nonhydrolyzed copolymer to above the gelatinization temperature of the natural potato starch in the absence of oxidizing agents, polymerization initiators and alkali.

* * * * *